US005669587A

United States Patent [19]

Van Alstine et al.

[11] Patent Number: 5,669,587

[45] Date of Patent: Sep. 23, 1997

[54] POINT DETECTION AND INDICATION WITH LATCH OUT MEANS

[75] Inventors: Daniel W. Van Alstine, Rochester, N.Y.; George E. Ludwick, Tequesta; George A. Bonner, Palm Beach Gardens, both of Fla.; Mark Hager, Rochester, N.Y.; Charles M. Eggebrecht, Chruchville, N.Y.; Allen Baughman, Rush, N.Y.; Barry A. Taft, Rochester, N.Y.

[73] Assignee: General Railway Signal Corporation, Rochester, N.Y.

[21] Appl. No.: 603,152

[22] Filed: Feb. 16, 1996

Related U.S. Application Data

[63] Continuation-in-part of Ser. No. 541,924, Oct. 10, 1995, abandoned, which is a continuation of Ser. No. 293,126, Aug. 19, 1994, abandoned.

[51] Int. Cl.[6] ..... E01B 7/00

[52] U.S. Cl. ..... 246/220; 246/448; 246/476

[58] Field of Search ..... 246/220, 393, 246/401, 415 R, 448, 476

[56] References Cited

U.S. PATENT DOCUMENTS

| | | | |
|---|---|---|---|
| 2,740,041 | 3/1956 | Marcum | 246/220 |
| 5,116,006 | 5/1992 | Ocampo | 246/220 |
| 5,192,038 | 3/1993 | Ocampo | 246/220 |
| 5,292,091 | 3/1994 | Callegari et al. | 246/448 |

OTHER PUBLICATIONS

"Service Manual SM–6263, US&S M–3, M–23A and M–23B Electric Switch Machines" by the Massachusetts Bay Transportation Authority, section 3.4 and FIGS. 3–6 through 3–10.

Technical Specificaton of KW16 Switch by Electro Switch Corp.

*Primary Examiner*—S. Joseph Morano

*Attorney, Agent, or Firm*—Ohlandt, Greeley, Ruggiero & Perle

[57] ABSTRACT

There is provided an electric motor driven switch machine for positioning a railroad track at a switching point having rail point detection and indication mechanism. In particular, the detection and indication mechanism has a latch out mechanism that identifies a latch out condition when the railroad tracks are not at, or near, their proper positions before or after switching the railroad tracks. The detection and indication mechanism includes a four bar linkage which comprises a point detector bar, two cam followers, and a link arm assembly. The cam followers, supported in part by the link arm assembly, are connected to two point detector switches, so that the switch machine is operating when either one of these switches is closed or the railroad tracks are being switched. The latch out mechanism, located on the link arm assembly, may produce and indicate a latch out condition, thereby causing the two point detector switches to be held open until the railroad tracks are switched again from a remote location or at the switch machine. Optionally, a latch out switch may be added to the detection and indication mechanism in order to sustain the latch out condition and prevent the railroad tracks from being switched from a remote location until a safe condition is restored manually at the switch machine.

35 Claims, 13 Drawing Sheets

POINT DETECTION AND INDICATION WITH LATCH OUT MEANS

RELATED APPLICATION

This is a continuation-in-part of application Ser. No. 08/541,924, filed on Oct. 10, 1995 now abandoned, which is a continuation of application Ser. No. 08/293,126, filed on Aug. 19, 1994, now abandoned.

Reference is made to United States patent application Ser. No. 08/293,121, filed on Aug. 19, 1994, titled LOW PROFILE SWITCH MACHINE and U.S. patent application Ser. No. 08/293,127, filed on Aug. 19, 1994, titled SWITCH MACHINE CAM BAR that relate to art similar to the present application and are commonly owned by the applicant.

BACKGROUND OF THE INVENTION

I. Field of the Invention

The present invention relates generally to a electric motor driven switch machine for switching railroad tracks so that trains may switch from one track to another. More particularly, the present invention relates to a point detection and indication apparatus of a switch machine for detecting whether a railroad track has been properly switched and indicating this information locally at the switch machine or at a remote location. The present invention also relates to a latch out means for indicating whether an improper operation has occurred with the switch machine.

II. Description of the Prior Art

A common method for switching a train from one railroad track to another is to install an electric motor driven switch machine next to a switching point of the track. Since modern versions of these switch machines are usually operated from a remote location, it is essential that a remote operator be able to determine that the switch has, in fact, been thrown as requested. This capability is provided by a rail point detection and indication system of a switch machine.

Switch machines and their installation sites are exposed to many environmental hazards throughout their normal use within railroad networks. These hazards include wear, loosening of fasteners, foreign object contamination, vandalism, environmental obstructions such as ice and snow. These factors and others cause the switch point location of a railroad track to change from its original position as installed or to fail to reach a proper position when the railroad track is switched by the switch machine. Thus, the detection and indication system of a switch machine typically has a tolerance limit to allow for some error between the expected and actual location of the switching point, and an adjustment means for setting the tolerance limit at an acceptable level.

Some switch machines include a latch out means which permits a switch machine to operate properly with some additional tolerance to error, thus providing the switch machine with a higher tolerance limit. Many switch locations are remote from the operational and maintenance personal of a railroad operation. A latch out means allows a switch machine to operate with a higher tolerance limit and, thus, to reduce and minimize excessive maintenance actions and possible train delays caused thereby. When this tolerance limit is reached, the detection and indication system of the switch machine is arranged to be latched out, the latch out mechanism thereby preventing a remote operator from receiving a "safe condition" indication from the detection and indication system.

A latch out means of a switch machines can either be restorable or non-restorable. With a restorable latch out means, operational personnel may "cycle" the switch from a remote location to try to clear a problem that has caused the switch machine to latch out. For example, where the switching of railroad tracks at a switch point is obstructed by ice, snow, or small rocks, the obstruction may possibly be cleared from a remote location by repeated switching of the tracks to and from the switch point. If the obstruction is cleared and the track is switched to a position within the allowable tolerance limit, the latch out means will allow the detection and indication system to signal "safe condition" indication to a remote operator, and the switch machine will be allowed to continue to operate.

For a non-restorable latch out means, remote cycling is not permitted, and the switch machine must be inspected and restored manually by maintenance personnel at the switch. Manual inspection and restoration may be desirable to some railroad operators since the maintenance personnel will also have an opportunity to check the switch machine for physical damage that would not be noticeable from a remote location.

In addition, switch machines typically have a point detector bar that detects the actual position of railroad tracks, relative to their expected position, and a lock bar that locks the railroad tracks in position at the end of a railroad track switching operation. A safety requirement of switch machines is to ensure the point detector bar and lock bar are in correspondence with each other before a "safe condition" may be indicated to a remote operator. A broken or missing lock bar connection, for example, would cause the lock bar to be out of correspondence with the point detector bar. If this condition exists, a "safe condition" will not be indicated by the detection and indication system.

Although it is known in the art to include a detection and indication system with a latch out means in switch machines, such systems remain complicated and expensive to manufacture, due to their intricate designs and numerous parts. For example, one prior art design positions a pair of cranks next to the point detector bar for detecting the position of the bar and a intricate assembly a yoke, gear, levers, cams and other various elements for determining whether a "safe condition" exists. Each crank has its own tension spring for adjusting the position of the crank. Also, the cranks are indirectly corresponding with the intricate assembly through a pair of connecting rods.

Due to the environmental and operational hazards exposed to switch machines and the cost of maintaining them, a simpler and more economical design over the prior art designs is desirable for switch machines. Thus, a simpler and more economical design of a detection and indication system having a latch out means would reduce the cost of manufacturing and maintaining a switch machine while retaining all necessary features and becoming less prone to environmental and operational hazards.

Accordingly, it is a primary object of the present invention to overcome the aforenoted disadvantages associated with the complicated designs of prior art detection and indication systems by reducing the number of required parts and using position detecting elements that are directly interacting with each other instead of indirectly responding through other elements.

Another object is to provide a detection and indication system having a simple design so that it is economical to manufacture and maintain.

An additional object is to provide a detection and indication system that provides all of the functionality of a latch out feature without significantly complicating the design or increasing the first cost or live cycle cost of the system.

A further object is to provide a detection and indication system having a simple, durable, reliable and economical design that includes a restorable or non-restorable latch out means.

A still further object is to provide a detection and indication system having a simple, durable, reliable, and economical design while ensuring a "safe condition" will not be indicated when the point detection bar and lock bar are not in correspondence with each other.

SUMMARY OF THE INVENTION

In fulfillment of the above stated and other objects, the problem noted above has been overcome by designing a detection and indication system of a switch machine with many new improvements. One improvement is to provide a system having a simple design, that is, a four bar linkage design comprising a point detector bar, two cam followers and a link arm assembly. Another improvement is to provide switch arms on the cam followers that directly activate the main indicating circuit of the switch machine. A further improvement is to provide a single link arm assembly that directly connects and supports the cam followers. A still further improvement is to provide a latch out means that integrates with the link arm assembly while still permitting the link arm assembly to directly connect the cam followers. Overall, the above improvements to the detection and indication system relates to the simpler and more direct interconnection of the four bar linkage design of the present invention.

Briefly described then, a preferred embodiment of the present invention is defined as follows. A point detection and indication apparatus for an electric motor driven switch machine, comprising: a point detector bar having an outer surface, a point detector cam positioned by the outer surface, a pair of cam followers, each of the cam followers having a first end adjacent to the outer surface and a second end, wherein the second end is positioned at a first position when the first end is positioned adjacent the point detector cam, and the second end is positioned at the second position when the first end is not positioned adjacent to the point detector cam, and a link arm, directly linking the second ends of the pair of cam followers, having tension means, the tension means for retracting a length of the link arm when at least one of the second ends shifts from the second position to the first position and for extending the length of the link arm when at least one of the second ends shifts from the first position to the second position.

A more specific embodiment of the present invention includes the following. A point detection and indication apparatus for an electric motor driven switch machine having an activation means, comprising: a point detector bar having an outer surface, a point detector cam positioned by the outer surface, a pair of cam followers, each of the cam followers having a first end adjacent to the outer surface and a second end, wherein the second end is positioned at a first position when the first end is positioned adjacent the point detector cam, and the second end is positioned at the second position when the first end is not positioned adjacent to the point detector cam, a link arm directly linking the second ends of the pair of cam followers, a pair of latch retainers positioned on the link arm, a pair of latch bars positioned about the link arm between the latch retainers, each of the latch bars having a contact end, each of the latch bars having a first latch position such that the contact end does not contact the latch retainer, and a second latch position such that the contact end contacts the latch retainer, a latch opener cam having an unlock position for positioning the latch opener cam between the latch bars and the latch bars at the first latch positions, and a lock position for positioning the latch opener cam to one side of the latch bars and the latch bars at the second latch positions, and a latch out switch, responsive to the activation means of the switch machine, for terminating the operation of the switch machine when the latch opener cam is at the lock position and both of the cam followers are at the second position.

In a second embodiment of the present invention, there is provided a point detection and indication apparatus for an electric motor driven switch machine which comprises a point detector bar having an outer surface and a point detector cam located on the outer surface, first and second cam followers, first and second switch arms and a switch assembly. The first and second cam followers each have a first follower end that is contiguous to the outer surface and a second follower end in which each cam follower has a first follower position when the first end portion is positioned adjacent the point detector cam and a second position when the first end portion is not positioned adjacent the point detector cam. The first switch arm is disposed on the first cam follower and the second switch arm is disposed on the second cam follower in which each switch arm has a distal end extending from the second end portion of the respective cam follower. The switch assembly has a pair of switching cams for receiving the distal ends of the switch arms and is for indicating a problem condition when the contacts are switched within a particular range of indicating positions. In addition, each distal end of the switch arms extend beyond a front vertical plane of the switch assembly.

Further, the switch assembly of the second embodiment includes a pair of rotatable shafts substantially perpendicular to the distal end of the switch arms and a switching cam disposed at an end of each rotatable shaft. The distal ends of the switch arms are capable of rotating the switching cams, and the switch assembly indicates a problem condition when the switching cams are rotated within a particular range of angular rotation.

Other and further objects, features and advantages of the present invention will be understood by reference to the following description in conjunction with the annexed drawings, wherein like parts have been given like numbers.

DETAILED DESCRIPTION OF THE PREFERRED EMBODIMENTS

Figure 1:
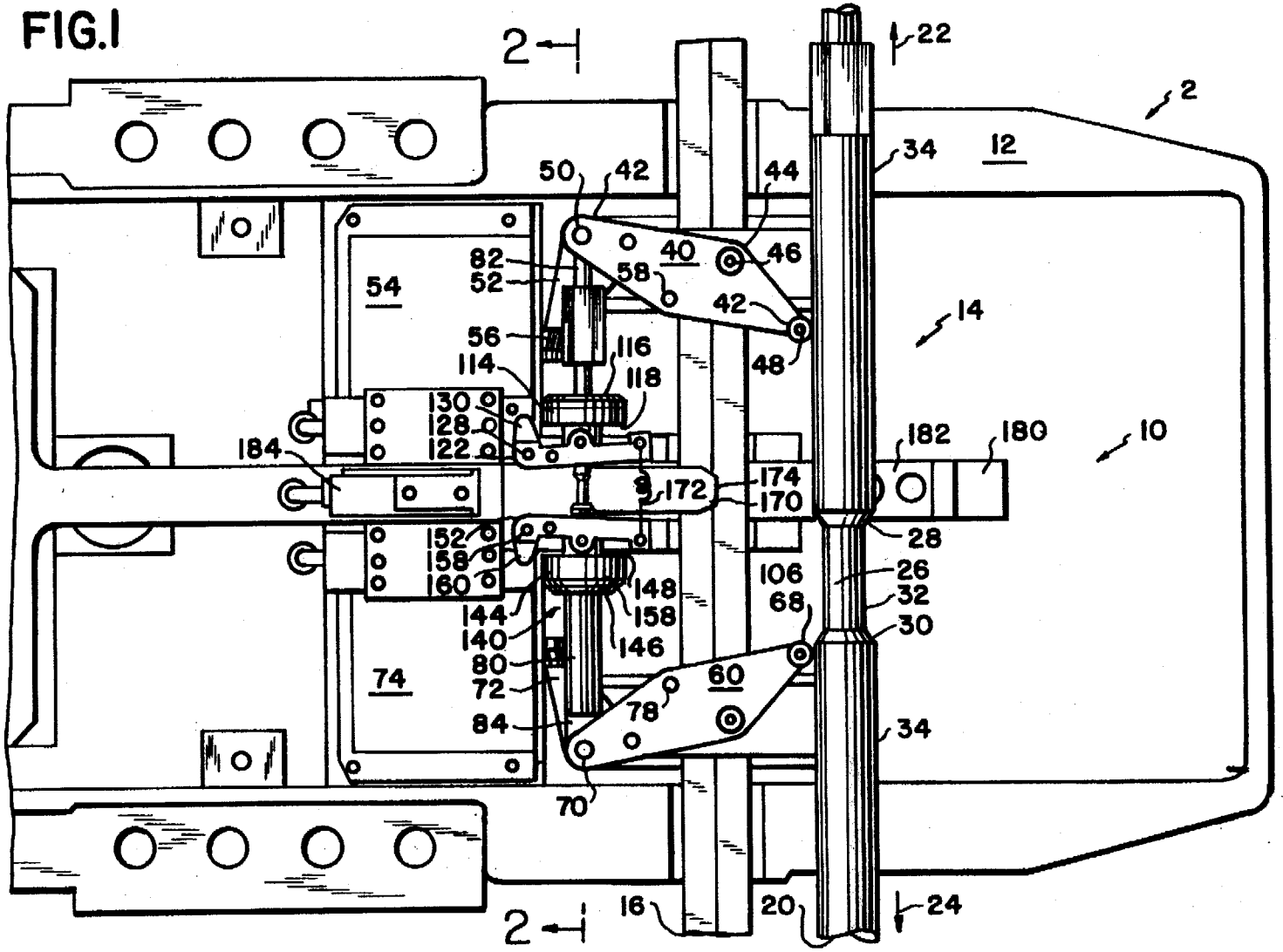
FIG. 1 is a planar view from above the first preferred embodiment of the present invention such that the top cover of the switch machine is omitted in order to show its inner components.
Figure 1A:
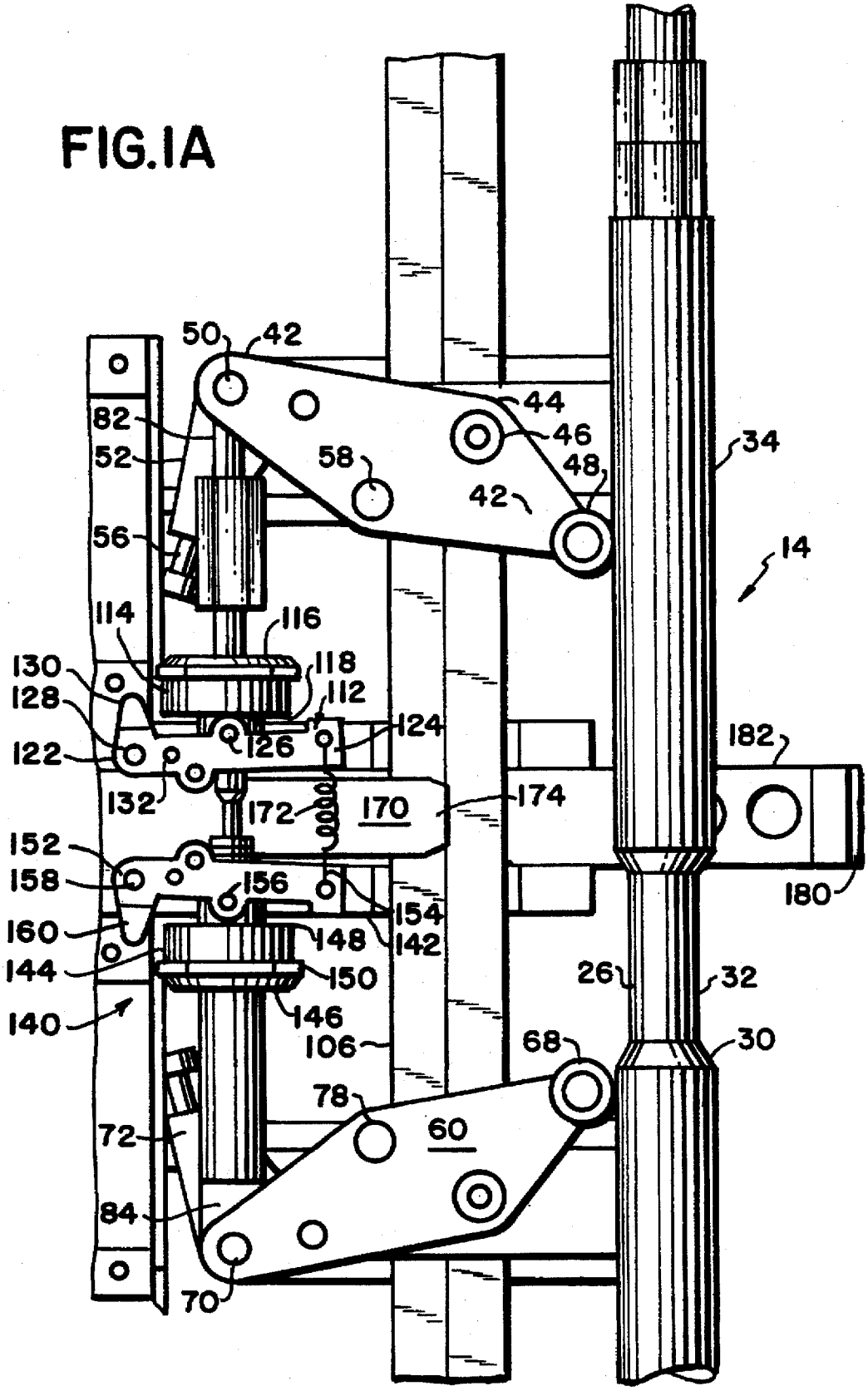
FIG. 1A is an enlarged view of the central portion of FIG. 1.

Referring to the drawings and, in particular, FIG. 1, there is generally provided a first preferred embodiment of a detection and indication system 10 of the present invention. The detection and indication system 10 is part of a switch machine that is located adjacent to a set of stock rails having a set of switching rails situated therebetween (not shown). Other than the detection and indication system 10 of the present invention, the general structure and positioning of switch machines relative to railroad tracks is known in the art and, therefore, will not be described in detail.

Referring specifically to FIG. 1, there is shown an overhead planar view of a portion of the switch machine 2 of the first preferred embodiment where the cover (not shown) of the switch machine has been omitted from the figure. Of the various components of the switch machine 2, only the base 12 of the switch machine and the elements relevant to the operation to the detection and indication system 10 are shown. The basic design of the detection and indication system 10 is in the form of a four bar linkage 14, which includes a point detector bar 20, two cam followers 40, 60, and a link arm assembly 80.

The point detector bar 20 is a long cylindrical rod positioned perpendicular across the longitudinal axis of the switch machine 2 such that movement by the point detector bar 20 corresponds to movement by switching rails relative to the position of stock rail on either side (not shown). The point detector bar 20 is capable of moving in two opposing directions: a normal direction 22 and a reverse direction 24. When the point detector bar 20 is moving toward the railroad tracks (upward in FIG. 1), the bar is moving in a normal direction 22; when the point detector bar is moving in the opposite direction away from the railroad tracks (downward in FIG. 1), the bar is moving in a reverse direction 24.

A point detector cam 26 formed at a fixed position on the point detector bar 20 such that the detection and indication system 10 can identify any movement by the switching rails by monitoring the position of the point detector cam 26. The point detector cam 26 is an elongated notch grooved at a small portion of the point detector bar 20 having conical slopes 28, 30 at both ends. The conical slopes 28, 30 connect the smaller-diameter surface 32 of the point detector cam to the larger-diameter surface 34 of the rest of the point detector bar.

Adjacent to the point detector bar 20 is the normal cam follower 40 and the reverse cam follower 60. Since both cam followers 40, 60 have similar structures and functions, the normal cam follower is described in detail hereinafter, without equal reference to the reverse cam follower. Unless otherwise stated, the reverse cam follower 60 should be understood to have the same features as, or similar features to, the normal cam follower 40. The normal cam follower 40 has an elongated, diamond shape having two acute-angle corners 42 and two obtuse-angle corners 44. A pivot point 46 is situated at one of the obtuse-angle corners 44 for stabilizing the normal cam follower 40 to the base 12 of the switch machine 2. At the two acute-angle corners 42 are a roller 48 and an attachment point 50, located at opposite corners of the normal cam follower 40. The roller 48 is positioned adjacent to the point detector bar 20 whereas the attachment point 50 is rotatably attached to a normal end 82 of the link arm assembly 80. For the reverse cam follower 60, an attachment point 70 is rotatably attached to a reverse end 84 of the link arm assembly 80.

Also attached at the attachment point 50 of the normal cam follower 40 is a switch arm 52 extending beneath the link arm assembly 80 to a normal point detector switch 54. From the view of FIG. 1, the normal point detector switch 54 is located to the upper left of the four bar linkage 14 (and a reverse point detector switch 74 is located to the lower left of the four bar linkage). An adjustment screw 56 is integrated within the switch arm 52 so that the switch arm can be manually and adjustably aligned with the normal point detector switch 54. Operationally, when the normal cam follower 40 pivots around the pivot point 46 in a clockwise direction, the switch arm 52 presses into the normal point detector switch 54. Likewise, when the normal cam follower 40 pivots in a counter-clockwise direction, the switch arm 52 releases the normal point detector switch 54.

It should be noted that both the normal point detector switch 54 described above and the corresponding reverse point detector switch 74 are push-to-open switching devices. In other words, when the switches 54, 74 are pressed inward by their respective switch arms 52, 72, their circuits are opened and in their "off" position. When the switches are released as their respective switch arms 52, 72 move away from them, their circuit are closed and the switches in their "on" position.

As described above, FIG. 1 shows the two attachment points 50, 70 of the cam followers 40, 60 directly connected by the ends 82, 84 of the link arm assembly 80. The main body extending through the entire link arm assembly 80 is a link arm 86 having the capability of extending and retracting based on the lateral force applied at the ends 82, 84 of the link arm assembly.

Figure 2:
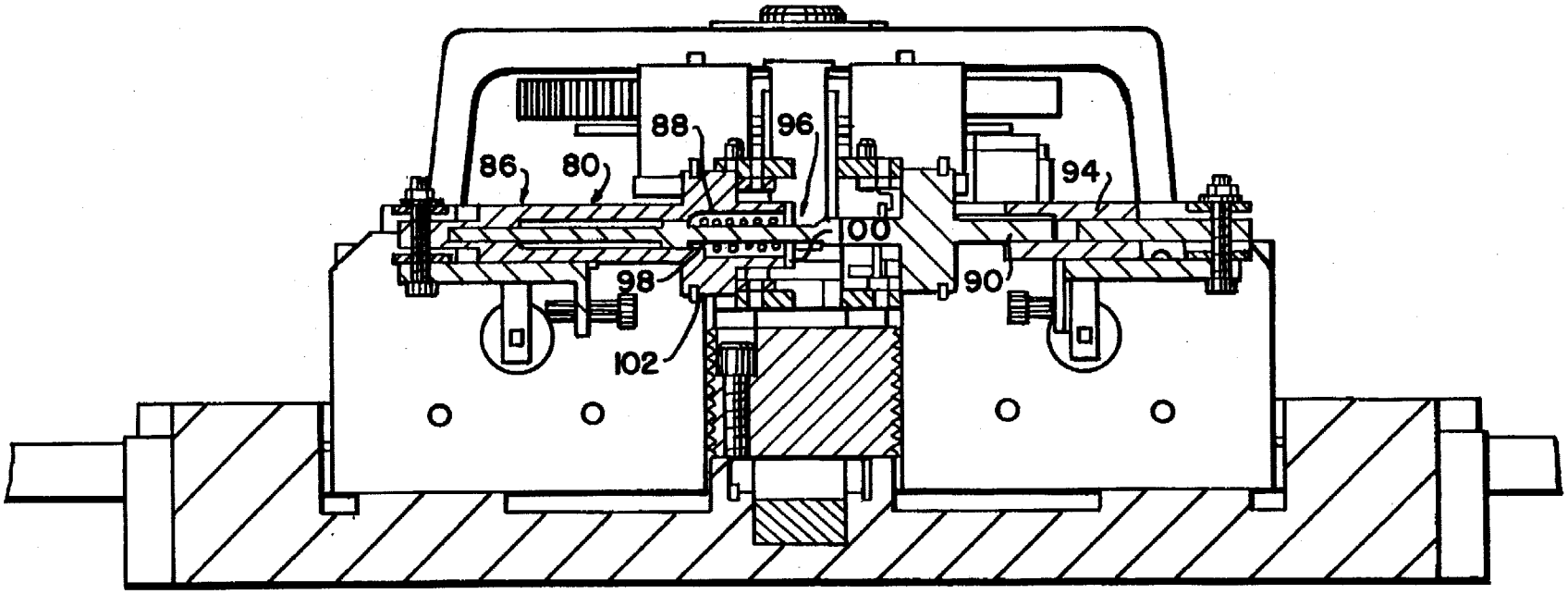
FIG. 2 is a cut-view of the first preferred embodiment of FIG. 1 showing a cross-sectional view of the link arm assembly through line 2—2 and a further view of its surrounding elements.

Referring to FIG. 2, the tension means 88 that provides the extension and retraction capability to the link arm assembly 80 is shown. The link arm 86 mainly comprises an inner sleeve 90 that extends for almost the entire length of the link arm 86 and an outer sleeve 92 that only extends for about half of the length of the link arm. The inner sleeve 90 includes an adjustment coupler 94 for adjusting the length of the inner sleeve, and thus the length of the link arm 86, to a desired length. The inner sleeve 90 slides into an inner bore 96 of the outer sleeve 92 and is held at that approximate position by a tension spring 98. One end of the tension spring 98 rests against a shoulder 100 of the outer sleeve 92 whereas the other end rests against a shoulder 102 of the inner sleeve 90. Therefore, the tension of the tension spring 98 pressing against the two shoulders 100, 102 of the outer and inner sleeves 90, 92 retracts the link arm 86 to its minimum length. However, the tension spring 98 also allows the link arm 86 to extend when a force pulls the link arm at either of its two ends 82, 84. For example, when the attachment point 50 of the normal cam follower 40 pulls the inner sleeve 90 of the link arm 86 away from the outer sleeve 92, the tension spring 98 compresses, thereby, allowing the entire link arm to extend in length. In the manner just described, the tension means 88 naturally tries to keep the link arm 86 at its minimum length but will allow the link arm to extend when a pulling force is applied to one or both of its ends 82, 84.

Referring again to FIG. 1, the latch out means of the first preferred embodiment comprises a pair of latch retainers 110, 140, a pair of latch bars 112, 142 and a latch opener cam 170 that interact with the link arm 86. The normal latch retainer 110 is attached to the inner sleeve 90 of the link arm 86 whereas the reverse latch retainer 130 is attached to the outer sleeve 92. Each latch retainer 110, 140 has a retainer body 114, 144 with a ring end 116, 146 and a non-ring end 118, 148, such that a retainer ring 120, 150 is located at the ring end of the retainer body.

Figure 3:
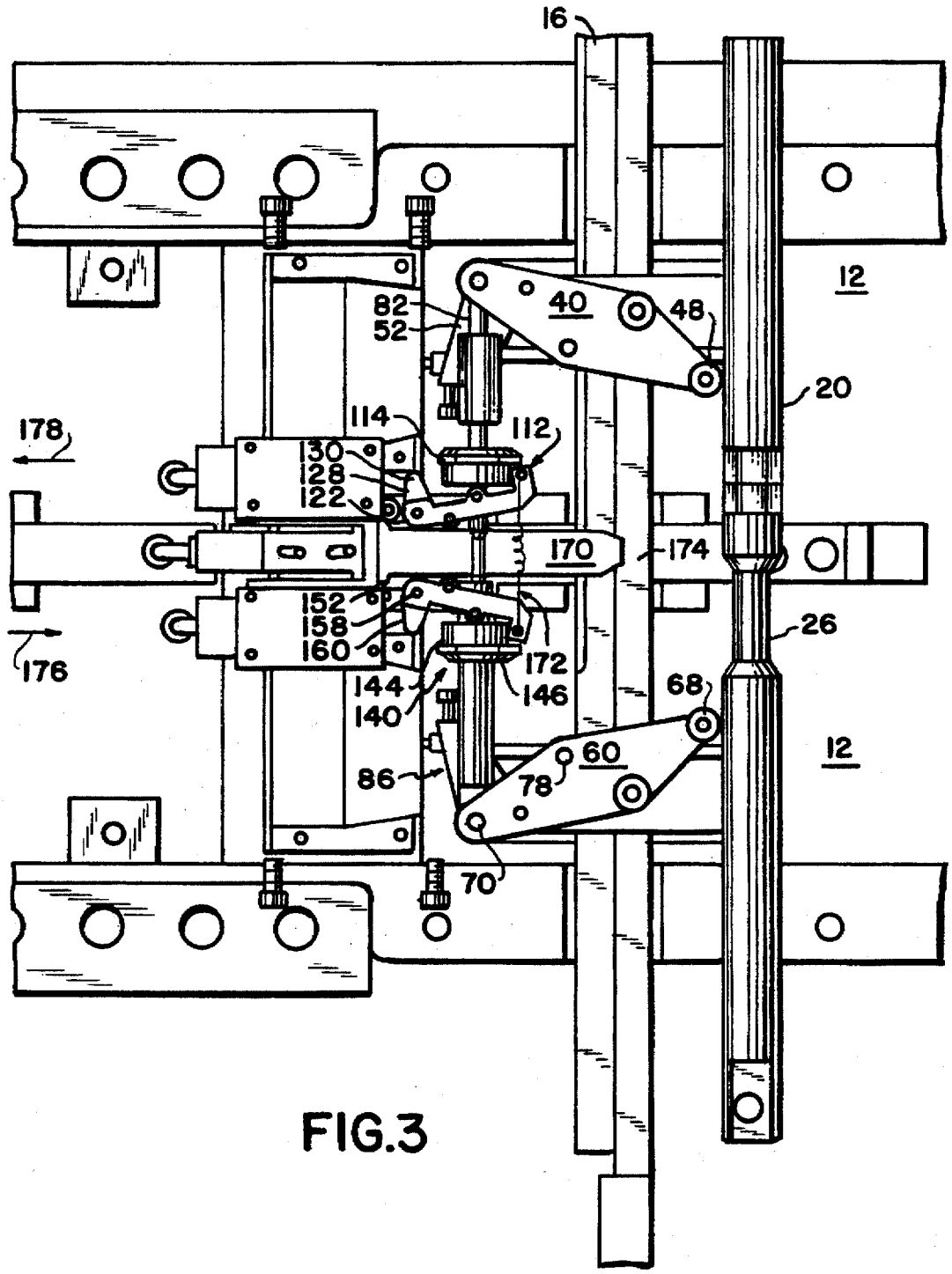
FIG. 3 is a planar view of the first preferred embodiment of FIG. 1 such that the switch machine is in mid-stroke.
Figure 3A:
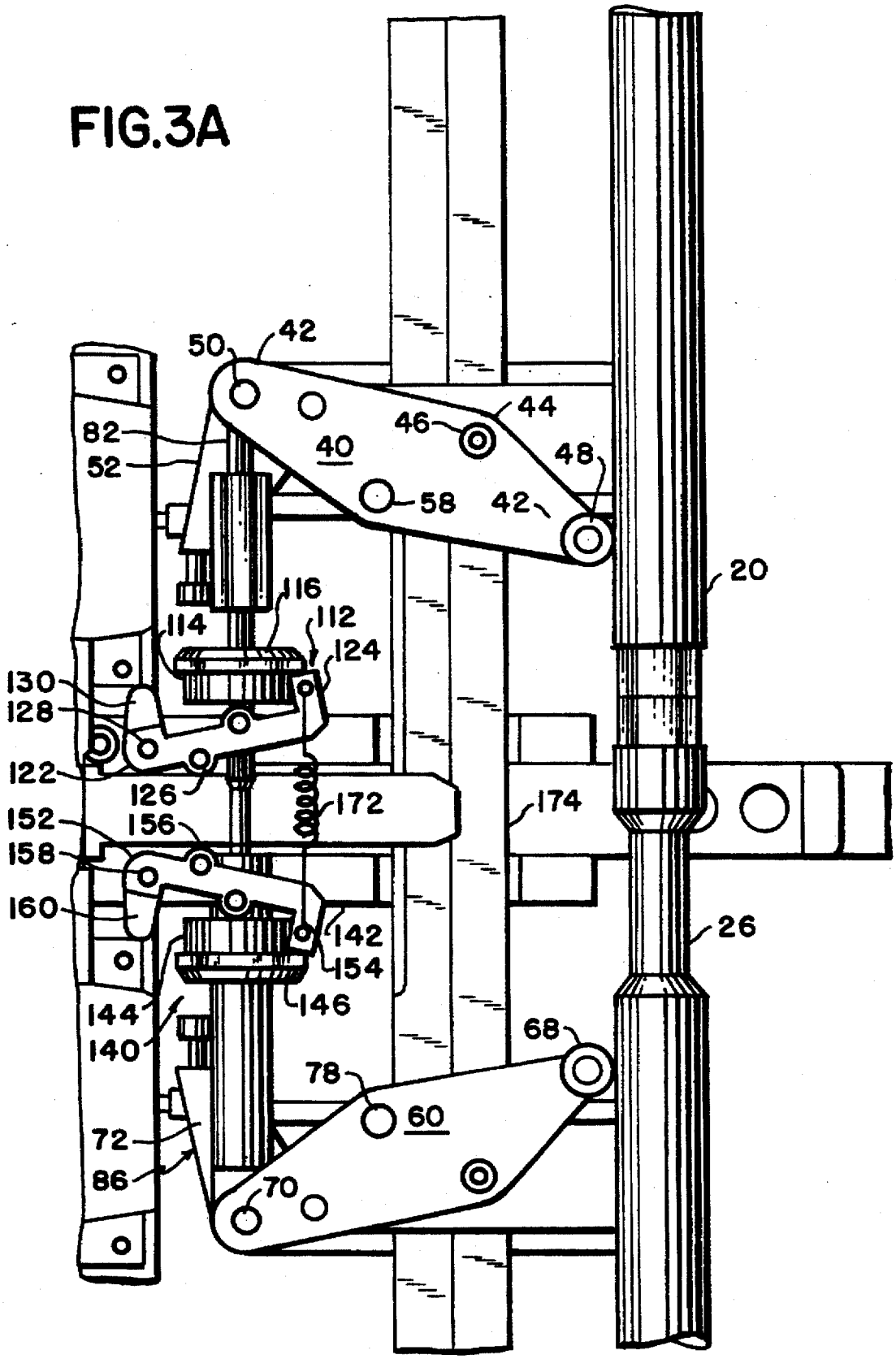
FIG. 3A is an enlarged view of the central portion of FIG. 3.

Referring to FIG. 3, the normal latch bar 112 and the reverse latch bar 142 are situated between the latch retainers 110, 140. Each latch bar 112, 142 has a pivoting end 122, 152 and a spring end 124, 154 with a middle abutment 126, 156 therebetween. The latch bars 112, 142 are pivotally mounted to the base 12 of the first preferred embodiment at a pivot point 128, 158 at the pivoting end 122, 152. Also located at the pivoting ends 122, 152 are latch bar abutments 130, 160 that extend adjacent to, or near, the latch retainers 110, 140. A latch spring 172 attaches to the spring ends 124, 154 of the latch bars 112, 142, opposite the pivoting ends 122, 152, and draws the spring ends toward each other. The latch bars 112, 142 are not in direct contact with the link arm 86, however the latch bars are capable of extending the length of the link arm by pressing their middle abutments 126, 156 against the non-ring ends 118, 148 of the latch retainers 110, 140.

Figure 4:
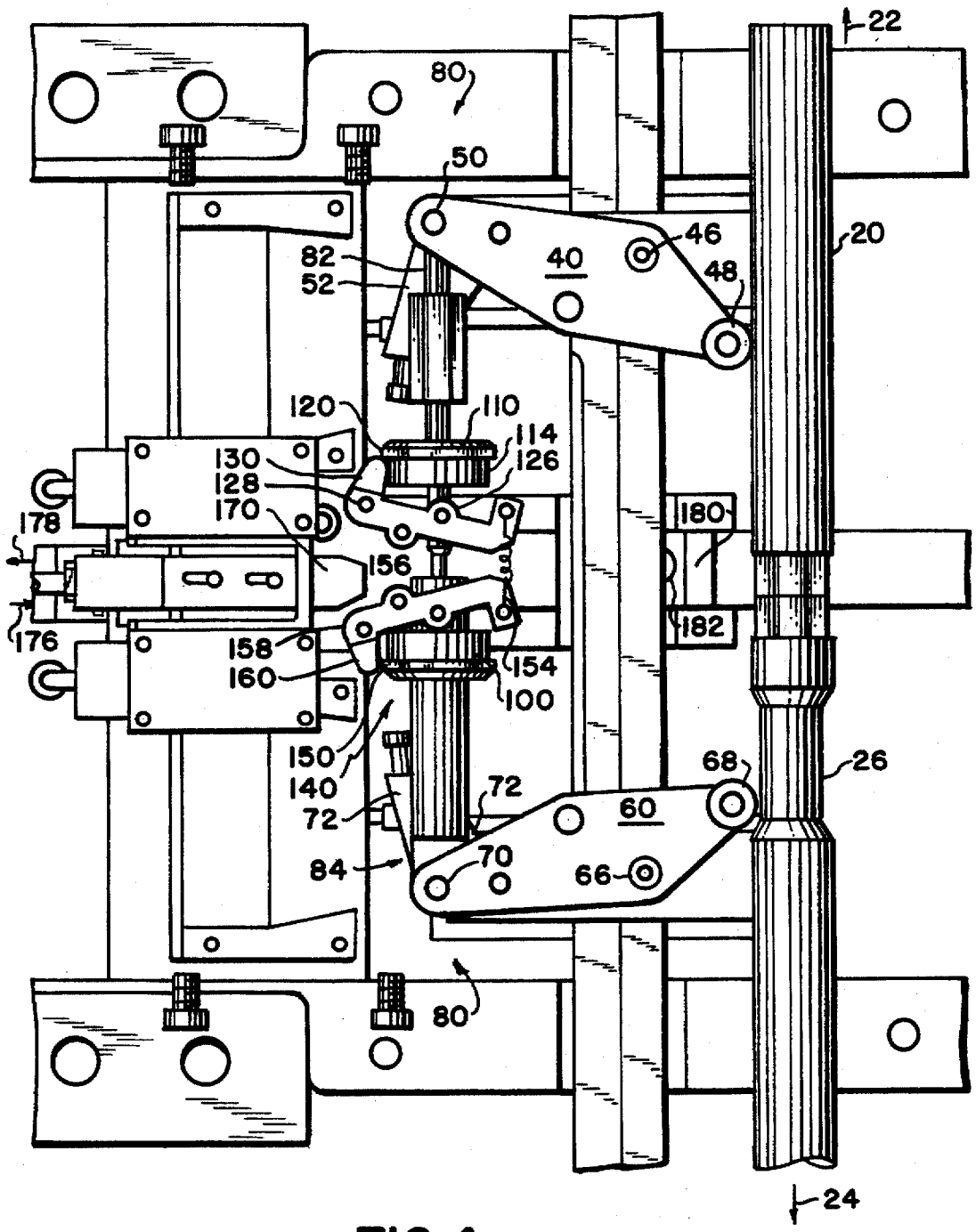
FIG. 4 is another planar view of the first preferred embodiment of FIG. 1 such that the switch machine is locked and indicating, but is not "latched-out".
Figure 4A:
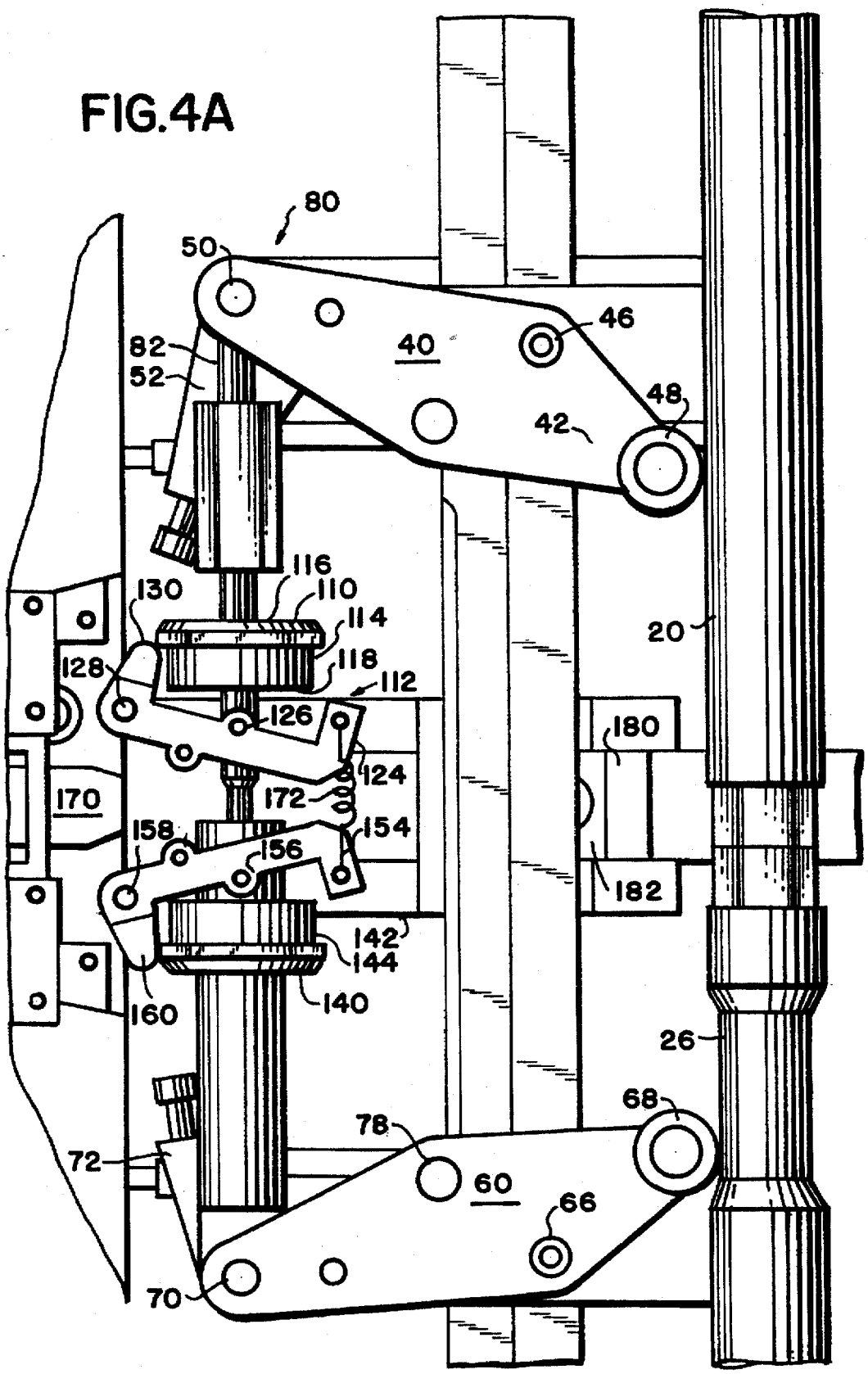
FIG. 4A is an enlarged view of the central portion of FIG. 4.
Figure 5:
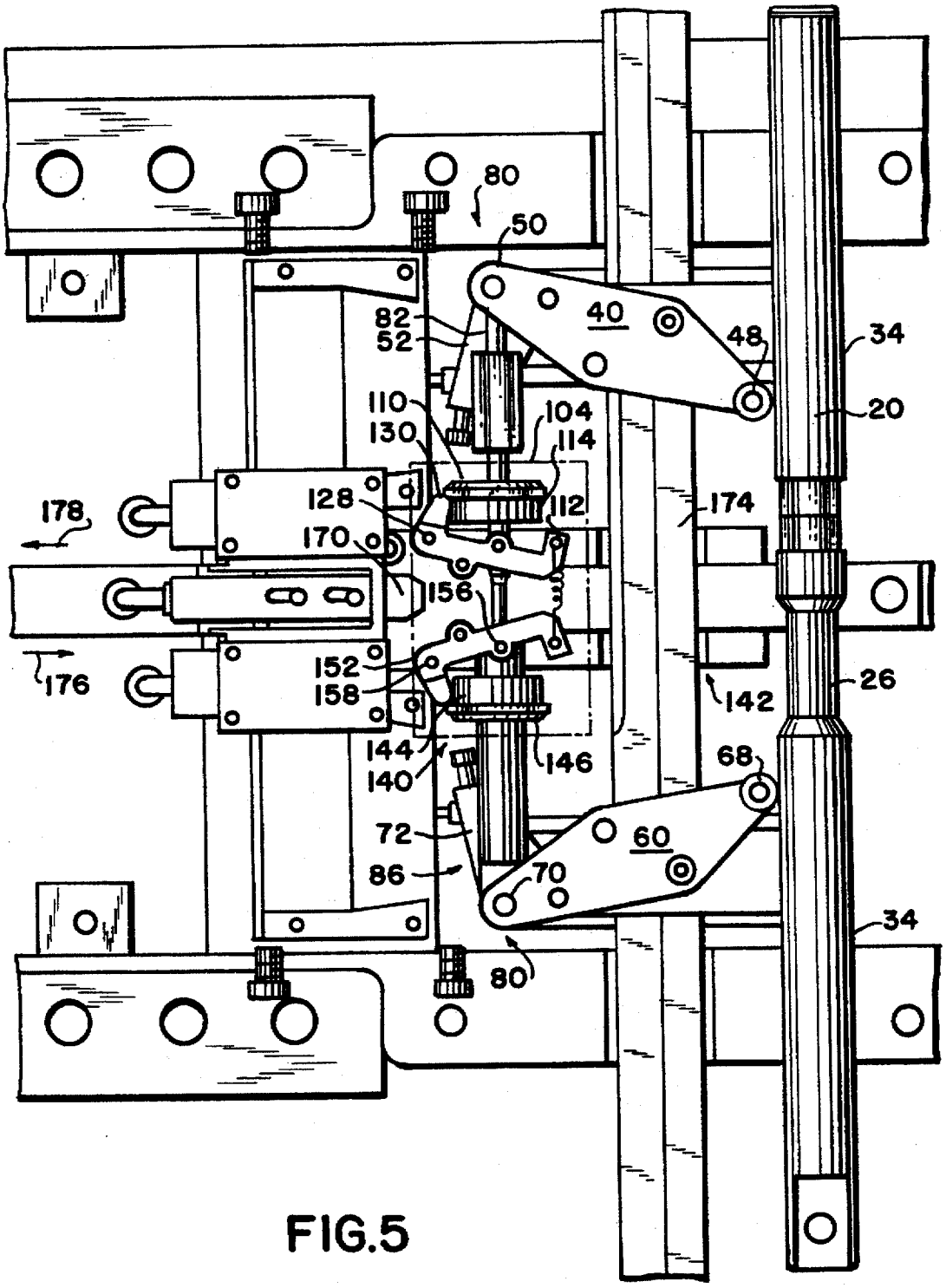
FIG. 5 is still another planar view of the first preferred embodiment of FIG. 1 such that the switch machine is "latched-out".
Figure 5A:
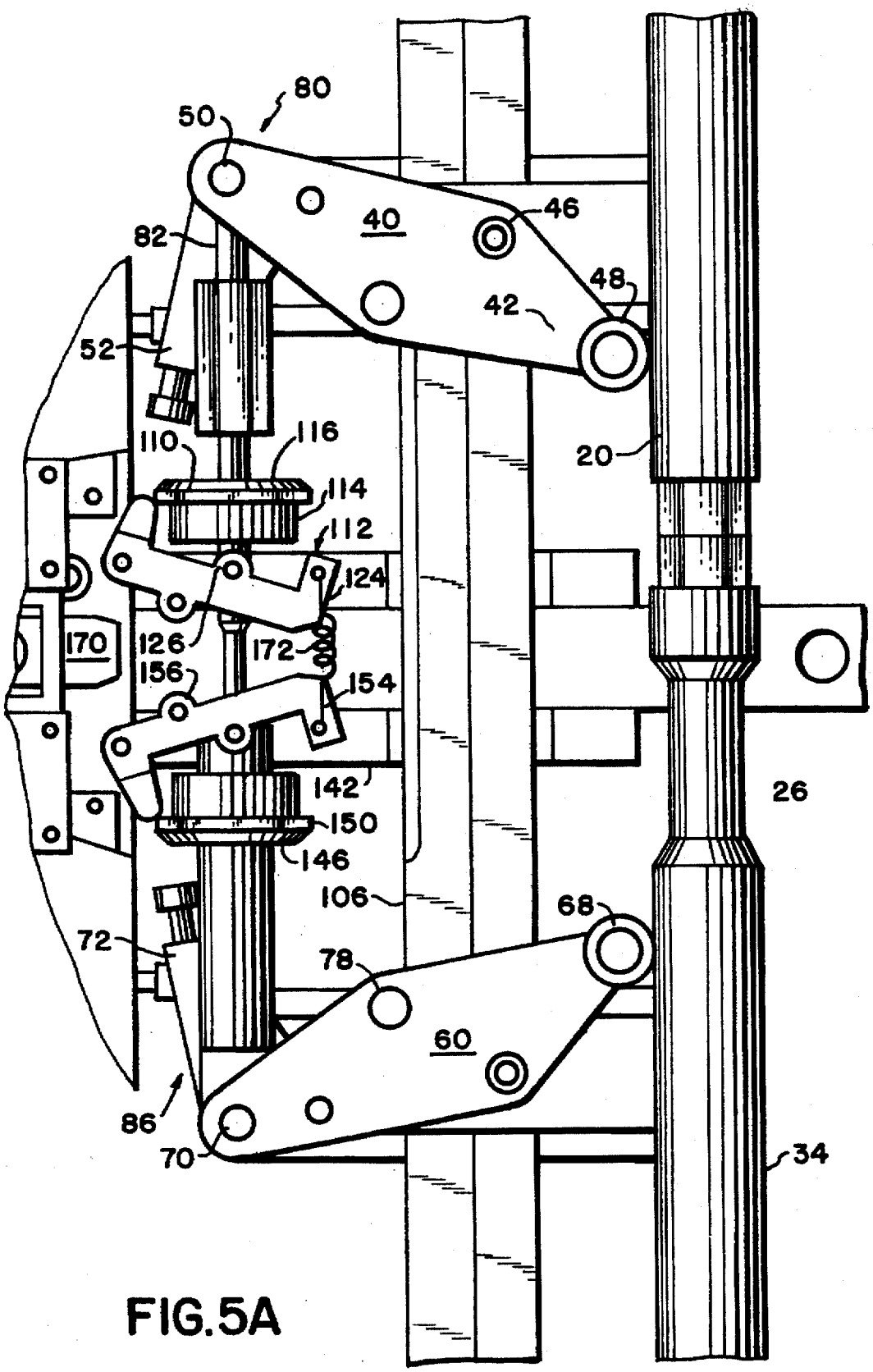
FIG. 5A is an enlarged view of the central portion of FIG. 5.

The latch opener cam 170 is a bar having 45 degree angled edges at one end 174 that has two positions: an unlock position 176 and a lock position 178. In the unlock position 176, the latch opener cam 170 is fully extended and separates the latch bars 112, 142, as shown in FIGS. 1 and 3. The latch bars 112, 142 rest against the latch opener cam 170 at their pivoting ends 122, 152 and rollers 132, 162 that are located on the latch bars between the pivoting ends and the middle abutments 126, 156. When the latch bars 112, 142 are in this substantially parallel position, hereinafter referred to as the first position, the latch bar abutments 130, 160 are not in contact with the latch retainers 110, 140. Referring to FIGS. 4 and 5, when the latch opener cam 170 is positioned in the lock position 178, it is withdrawn from between the latch bars 112, 142. Then, the latch spring 172 will pull the spring ends 124, 154 toward each other, and correspondingly, the latch bar abutments 130, 160 shall come in contact with the latch retainers 110, 140 as the latch bars 112, 142 pivot at their pivot points 128, 158.

As stated above and shown in FIG. 3, when the latch bars 112, 142 are not in contact with the latch retainers 110, 140, the latch bars are in the first position. When the latch opener cam 170 is in its lock position 178, the latch bar abutments 130, 160 shall come in contact with the latch retainers 110, 140 in either a second position or a third position. For the second position as shown in FIG. 4, one latch bar 112, 142 is resting on the retainer ring 120, 150 without touching the retainer body 114, 144, while the other latch bar is against both the retainer ring and the retainer body. In the interest of simplification, only one of these two situations is presented in FIG. 4, i.e., the situation where the reverse latch bar 142 is resting on the retainer ring 150 only and the normal latch bar 112 is against the retainer ring 120 and the retainer body 114. However, it shall be understood that all details relating this second position as described below may also apply to the situation where the normal latch bar 112 is resting on the retainer ring 120 only and the reverse latch bar 142 is against the retainer ring 150 and the retainer body 144.

When the reverse latch bar 112 is in its second position, as shown in FIG. 4, the latch spring 172 pulls the spring end 154 downward, thereby, pivoting the spring end clockwise. Of course, since the latch opener cam 170 is in its lock position 178 and withdrawn from between the latch bars 112, 142, the reverse latch bar is not held in its first position and may pivot freely. Similarly, the latch bar abutment 160 will pivot clockwise and abut against the retainer ring 150 of the reverse latch retainer 140, without touching the retainer body 144.

It is a requirement for the second position that the roller 68 of the reverse cam follower 60 be contiguous to the point detector cam 26 of the point detector bar 20. When the roller 68 of the reverse cam follower 60 is moved from a position not contiguous to the point detector cam 26 to a position contiguous to the point detector cam, the reverse cam follower rotates clockwise around its pivot point 66. At this time, the attachment point 70 of the reverse cam follower 60 pivots clockwise with the reverse cam follower and permits the link arm assembly 80 to retract. Normally when the link arm assembly 80 is in its extended position, the latch retainers 110, 140 are not in contact with the middle abutments 126, 156 of the latch bars 112, 142. However, in this case, where one of the two ends 82, 84 of the link arm assembly 80 is permitted to retract inward, the reverse latch retainer 140 comes in contact with the middle abutment 156 of the reverse latch bar 142. Therefore, with the reverse latch retainer 140 at this position, the latch bar abutment 160 rests on the retainer ring 150 but does not come in contact with the retainer body 144.

In the third position, as shown in FIG. 5, the detection and indication system 10 of the switch machine 2 is said to be latched out and the latch out means 104 would prevent a remote operator from receiving a "safe condition" indication. The operation of the latch bars 112, 142 in order to set in the third position is similar to the operation for the second position. However, the resulting position for the third position is quite different, mainly, the latch bar abutments 130, 160 of the latch bars 112, 142 are pressed against their respective retainer rings 120, 150 and retainer bodies 114, 144. In particular, the latch bar abutments 130, 160 wedge themselves at the corners formed where the retaining bodies 114, 144 and retaining rings 120, 150 join.

The difference in the resulting positions for the second and third positions is due to the positions of the rollers 48, 68 of the cam followers 40, 60 with respect to the point detector cam 26. As noted above, one of the rollers 48, 68 is adjacent to the point detector cam 26, as shown in FIG. 4, in order to be in the second position. On the other hand, in order to be in the third position, as shown in FIG. 5, both rollers 48, 68 must be on the larger diameter surface 34 of the point detector bar 20, away from the point detector cam 26. These positions of the rollers 48, 68 force the cam followers 40, 60 to pull at both ends 82, 84 of the link arm assembly 80 and extend the link arm 86. Thus, the middle abutments 126, 156 of the latch bars 112, 142 are moved away from the non-ring ends 118, 148 of the latch retainers 110, 140, and the latch bar abutments 130, 160 pivot down into the corners formed between the retainer bodies 114, 144 and retainer rings 120, 150.

The three aforementioned positions of the latch bars 112, 142 determines the status of the detection and indication system 10 at any given time. When the latch bars 112, 142 are in their first position, as shown in FIG. 3, the switch machine 2 is in the process of switching the switch tracks between the stock rails. Within the switch machine 2, the point detector bar 20 is moving from one side of the switch machine to another. Also, the latch opener cam 170 moves between the latch bars 112, 142, and then withdraws therefrom, in order to reposition the latch bars. If one of the rollers 48, 68 of the cam followers 40, 60 is contiguous to the point detector cam 26 with the latch opener cam 170 withdrawn, the latch bars 112, 142 will be in the second position. If neither of the rollers 48, 68 are adjacent to the point detector cam 26 with the latch opener cam 170 withdrawn, the latch bars 112, 142 will be in the third position.

When the latch bars 112, 142 are in the second position, as shown in FIG. 4, the switch machine 2 is locked and indicating but not latched-out. Since one of the rollers 68 of the cam followers 60 is contiguous to the point detector cam 26, the switch arm 72 of the corresponding cam follower is pressing the point detector switch 74, i.e., that switch is "on". As the point detector bar 20 moves from the normal to the reverse direction 24, the roller 68 on the reverse cam follower 60 rolls onto the point detector cam 26, rotating the reverse cam follower 60 and, thereby, releasing the switch arm 72 from the reverse point detector switch 74. The reverse point detector switch 74 closes and indicates that the switching rail is within a certain distance, i.e., an allowable tolerance limit, from the stock rail. A cam lock bar 180 continues to move toward the lock direction 178, similar to the latch opener cam 170, and engages a cam lock lug 182 to the lock bar 16. This motion of the cam lock bar 180 also causes the latch opener cam 170 to move in the same direction and withdraw from between the latch bars 112, 142. Thus, the latch bars 112, 142 rotate in opposite directions due to the tension of the latch spring 172. Since the roller 68 on the reverse cam follower 60, not the roller 48 on the normal cam follower 40, rolled onto the point detector cam 26, the latch bar abutment 130 of the normal latch bar 112 will contact the retainer body 114 and retainer ring 120, but the latch bar abutment 160 of the reverse latch bar 142 will be held by the retainer ring 150. The switch machine 2 will now signal a "safe condition" indication to an operator. Similarly, if the roller 48 of the normal cam follower 40 had rolled onto the point detector cam 26, a "safe condition" would also be indicated.

When the latch bars 112, 142 are in the third position, as shown in FIG. 5, the switch machine 2 is latched-out. The latch out means 104 of the first preferred embodiment interacts with the link arm assembly 80 in such a way as to control the extension and retraction capability. Specifically, the latch out means 104 holds the link arm assembly 80 at its extended length, thereby holding the normal cam follower 40 at its clockwise position and the reverse cam follower 60 at its counter-clockwise position. During a latch out situation, the cam followers 40, 60 are held at these positions and will not be responsive to any movement by the point detector bar 20 even when the point detector cam 26 is positioned near one of the rollers 48, 68. Also, the switch arms 52, 72 of both cam followers 40, 60 will be pushing against both point detector switches 54, 74. Thus, during the latch out condition, both point detector switches 54, 74 are at their "off" positions.

Normally, after the switch machine 2 has switched tracks, the latch bars 112, 142 will be in the second position since one of the cam followers 40, 60 will have a roller 48, 68 contiguous to the point detector cam 26. However, for an abnormal condition, the latch bars 112, 142 will be in the third position since the rollers 48, 68 of both cam followers 40, 60 will not be contiguous to the point detector cam 26 at some time period after switching tracks. For example, if the tracks have not moved a certain distance that is within the tolerance limit, the point detector bar 20 will not move far enough for a roller 48, 68 to roll onto the point detector cam 26. In another example, beginning with the latch bars 112, 142 in the second position, an abnormal movement of the switching tracks may cause the point detector bar 20 to move, thereby removing a roller 48, 68 from the point detector cam 26. In such a case, even if one of the rollers 48, 68 moves back into the point detector cam 26, subsequently, the latch out means will hold the link arm assembly 80 at the extended position and the switch machine 2 would continue to be latched-out.

A latch out means 104 may be restorable or non-restorable. The configuration described above is restorable from a remote location and operations personnel can attempt to clear the switch point by repeated "cycling" of the switch machine 2. Thus, the latch bars 112, 142 may always be reset to the first position by switching the tracks from a remote location. If the obstruction is cleared, the latch bars 112, 142 will be in their second position and one of the point detector switches 54, 74 will close at the end of the switching operation. Normal switch machine operation will resumed without maintenance or operational personnel action at the switch location. However, if the original problem has not been corrected and the switch point distance from the stock rails is not within allowable tolerance, the switch machine 2 will simply latch-out again and prevent normal operation.

For non-restorable latch out, a latch out switch 184 is added to the restorable latch out configuration. The latch out switch 184 provides power to the motor of the switch machine 2 only during the rail switching operation. In a situation where the latch bars 112, 142 are in the third position and the switch machine 2 latches out, the switch machine may only be reset manually at the machine itself. If maintenance personnel "cycle" the machine with the hand crank or hand throw lever, the latch out means 104 will be reset and normal operation may be resumed.

Figure 6:
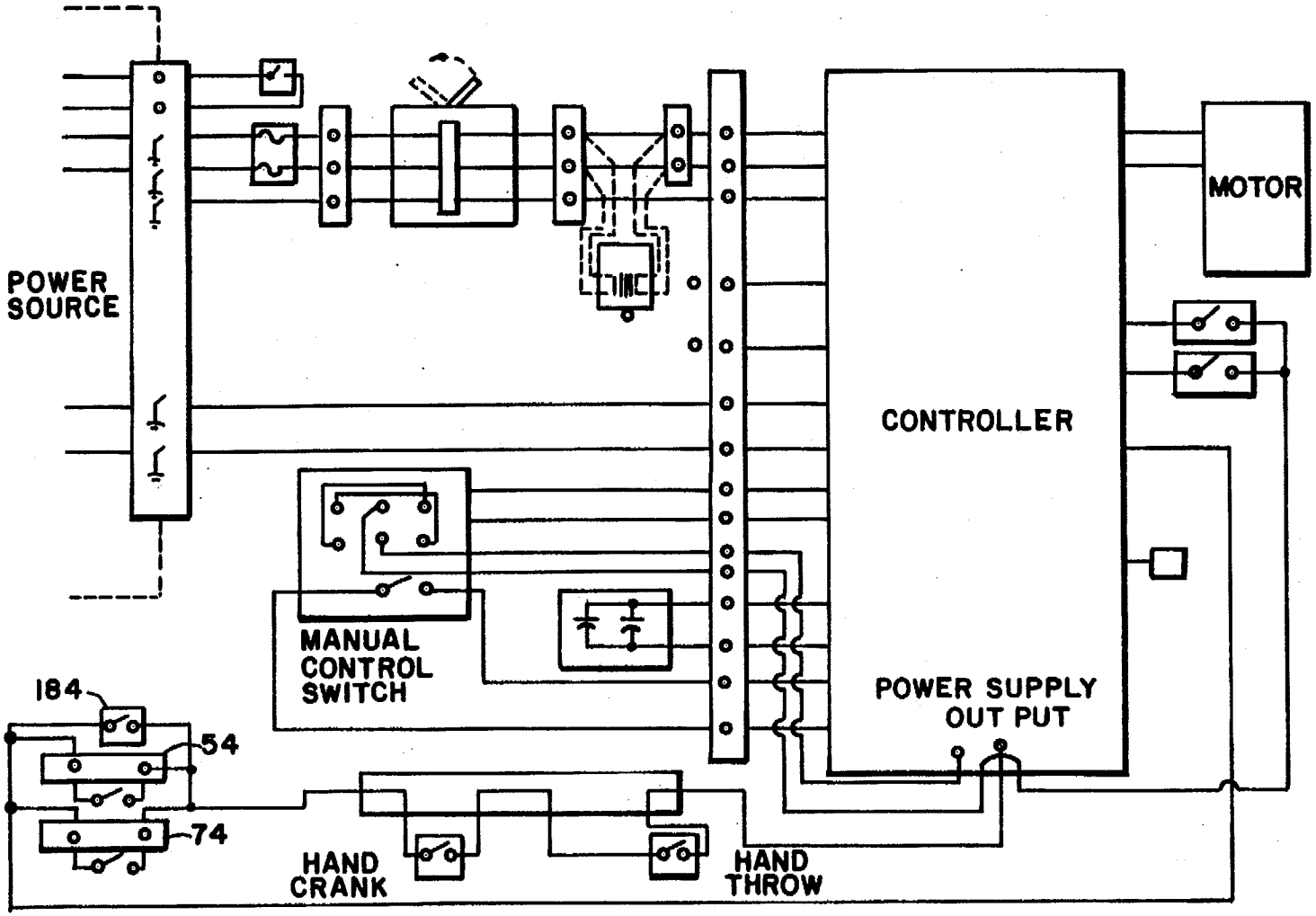
FIG. 6 is a circuit diagram of the main circuit of the first preferred embodiment shown in FIG. 1, including the latch out switch, normal point detector switch and reverse point detector switch.

Referring to FIG. 6, a switch machine 2 configuration with a non-restorable latch out is shown. A review of the switch machine wiring diagram indicates that the latch out switch 184, the normal point detector switch 54 and the reverse point detector switch 74 are wired in parallel. Any of these three electrical switches can be closed to operate the motor and cause the switching operation to occur. With the cam followers 40, 60 and latch bars 112, 142 in the latch out position, i.e., the third position, it will be noted that all three switches 54, 74 & 184 are open and operation of the switch machine 2 is prevented. For a switch machine configuration with a restorable latch out, the latch out switch 184 is removed and replaced with a jumper, and therefore, power is always supplied to the motor of the switch machine 2.

Another requirement of the switch machine 2 is to ensure the point detector bar 20 and the lock bar 16, that is located below both cam followers 40, 60 and parallel to the point detector bar, are in correspondence before a "safe condition" indication is provided. A broken or missing lock bar connection, for example, would cause the point detector bar to be out of correspondence. If this condition exists, a "safe condition" can not be indicated.

Referring again to FIG. 1 and as stated above in regard to the cam followers 40, 60, three of the corners of each cam follower 40, 60 have a pivot point 46, 66, roller 48, 68 and attachment point 50, 70, respectively. At the fourth corners of each cam follower 40, 60, opposite their pivot points 46, 66, are correspondence pins 58, 78 fixed to the cam followers. Each correspondence pin 58, 78 engages a slot 106 along one side of the lock bar 16 just below position of the pins on the cam followers 40, 60. If the lock bar 16 and point detector bar 20 are out of correspondence with respect to each other at the end of rail switching operation, one of the two correspondence pins 58, 78 will rest on the lock bar outside of the slot 106 and the switch arm 52, 72 corresponding to that pin will not release its point detector switch 54, 74 and, thus, the switch remains open. Thereafter, the switch machine 2 can not indicate a "safe condition" until this situation is corrected.

Figure 7:
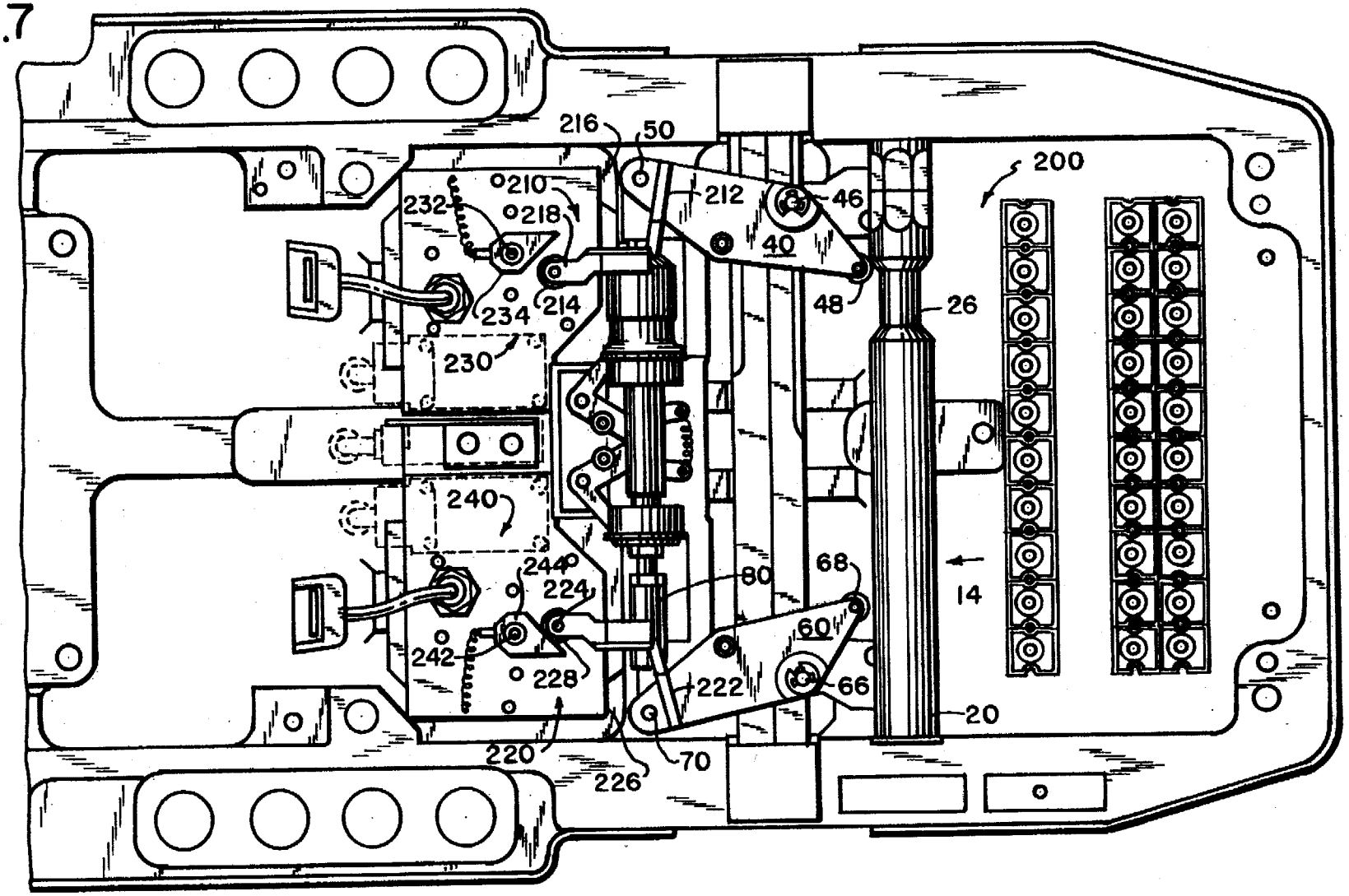
FIG. 7 is a top planar view from above the second preferred embodiment of the present invention such that the top cover of the switch machine is omitted in order to show its inner components.
Figure 8:
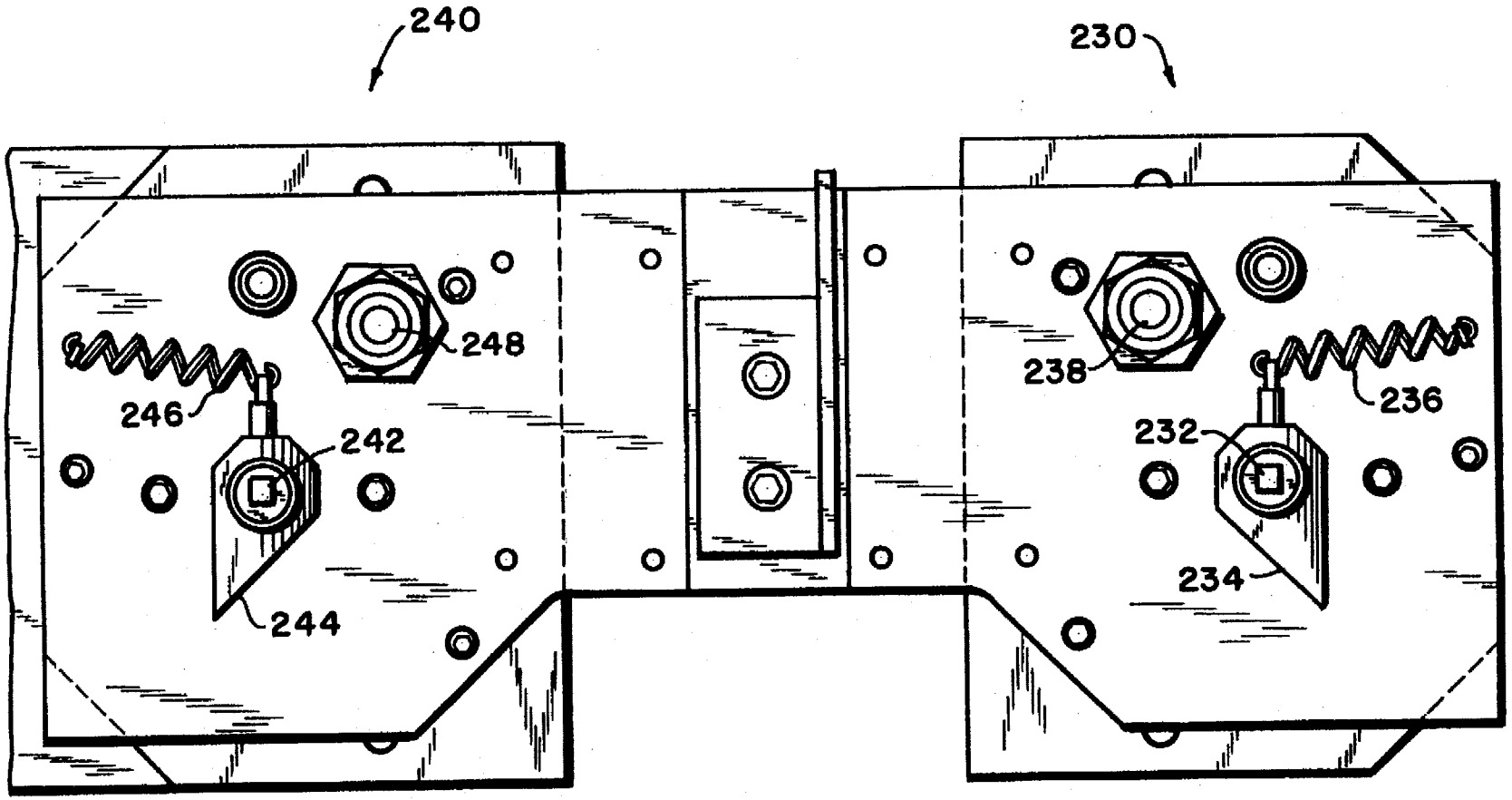
FIG. 8 is an enlarged view of the switches of the second preferred embodiment of FIG. 7.
Figure 9:
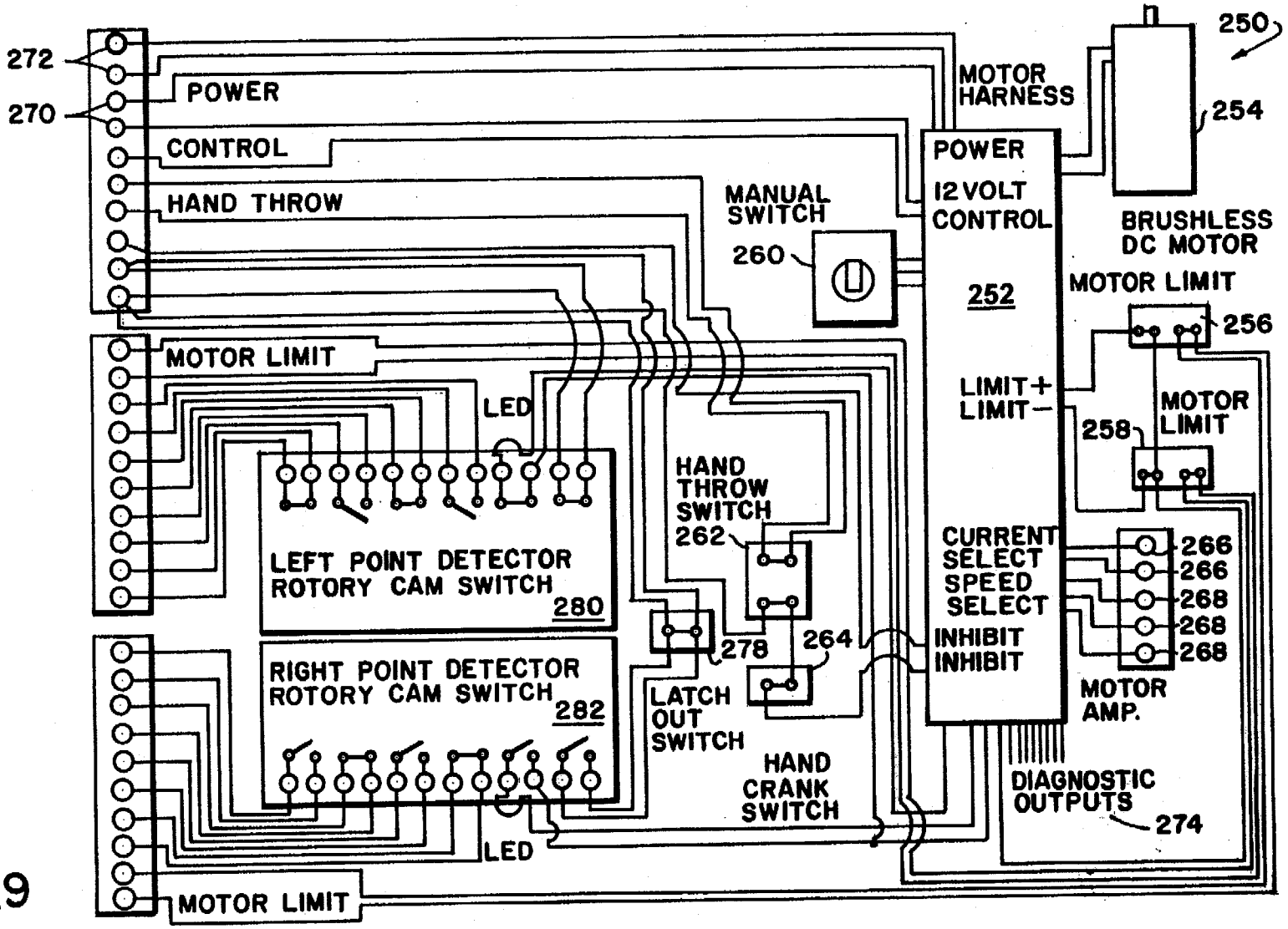
FIG. 9 is a circuit diagram of the main circuit of the second preferred embodiment of FIG. 7.

Referring to FIGS. 7 through 9, and in particular FIG. 7, there is generally provided a second preferred embodiment of the detection and indication system 200 of the present invention. Similar to the first preferred embodiment, the basic design of the detection and indication system 200 is the four bar linkage 14, which includes the point detector bar 20, the normal cam follower 40, the reverse cam follower 60, and the link arm assembly 80. The point detector bar 20 includes a point detector cam 26 formed at its the outer surface. The normal cam follower 40 includes a roller 48 at a first follower end and an attachment point 50 at a second follower end that is rotatably attached to the link arm assembly 80. Likewise, the reverse cam follower 60 includes a roller 68 at a first follower end and an attachment point 70 at a second follower end that is rotatably attached to the opposite end of the link arm assembly 80. In addition, the normal and reverse cam followers 40, 60 pivot about their respective pivot points 46, 66 so that as the rollers 48, 68 follow along the outer surface of the point detector bar 20, the attachment points 50, 70 shift accordingly.

Referring to FIG. 7, the structure and position of switch arms 210, 220 of the second preferred embodiment are different from that of the first preferred embodiment. The normal switch arm 210 has a substantially L-shaped form in which one end extends from an end portion 212 of the normal cam follower 40. The reverse switch arm 220 has a similar form in which one end extends from an end portion 222 of the normal cam follower 60. Unlike the first preferred embodiment, the normal and reverse switch arms 210, 220 of the second preferred embodiment extend over the link arm assembly 80 and above the switches 230, 240. Accordingly, both distal ends 214, 224 of the switch arms 210, 220 extend beyond front vertical planes of the system 200 represented by reference numerals 216 and 226 in FIG. 7.

The distal end 214 of the normal switch arm 210 and the distal end 224 of the reverse switch arm 220 are directed toward central axes or shafts 232, 242 of the switch devices 230, 240, respectively. Each distal end includes a roller 218, 228 for smooth, frictionless contact with the respective switching cams 234, 244 of the switch devices 230, 240. The distal ends 214, 224 of the switch arms 210, 220 each have a first position when the roller 48, 68 of the respective cam follower 40, 60 is positioned adjacent the point detector cam 26, and a second position when the roller is not positioned adjacent the respective point detector cam.

It is important to note that due to the pivoting nature of the normal cam follower 40, the distance of lateral movement of the distal end 214 across the switch device 230 is proportional to the distance from the distal end to the pivot point 46 of the normal cam follower. Likewise, the distance of lateral movement of the distal end 228 is proportional to the distance from the distal end to the pivot point 66 of the reverse cam follower 60. Thus, the lateral movement of the distal ends 218, 228 is greater than the parallel lateral movement of the attachment points 50, 70, respectively. Accordingly, since the switch arms 210, 220 of the second preferred embodiment extend further away from the respective pivot points 46, 66 than the switch arms of the first preferred embodiment, they provide a wider range of rotation for switching cams 234, 244.

Referring to FIGS. 7 and 8, the structure of the switch assembly of the second preferred embodiment is also different from the switch assembly or switches of the first preferred embodiment. In particular, the connections between the four bar linkage 14 and the switch assembly of the second preferred embodiment are made at the top surfaces instead of the front side surfaces of the switch devices. Thus, the switch assembly indicates a problem condition when the switching cams 234, 244 are rotated within a particular range of angular rotation. The switch assembly includes two switch devices each having a rotatable shaft 232, 242 positioned at a central vertical portion of each switch device 23,240. The rotatable shafts 232, 242 are substantially perpendicular to the distal ends 214, 224 of the switch arms 210, 220. A spring bias is attached to each switching cam 234, 244 to rotationally bias the cam against its respective switch arm, 210, 220. In addition, each switching cam 234, 244 has an angled surface for receiving the respective distal end 214, 224.

As the normal cam follower 40 pivots around the pivot point 46, the switch arm 210 will corresponding move with the attachment point 50 of the normal cam follower. In the process, the roller 218 at the distal end 214 of the switch arm 210 will press against, and release, the wedge-shaped switching cam 234 of the normal switch device 230 and rotate the same. Likewise, as the reverse cam follower 60 pivots around the pivot point 66, the roller 228 at the distal end 224 of the switch arm 220 will rotate and release the wedge-shaped switching cam 244 of the reverse switch device 240.

The normal point detector switch 230 and the reverse point detector switch 240 are rotary switching devices, preferably rotary cam switches, having multiple contacts. In other words, when the switches 230, 240 are rotated by their respective switch arms 210, 220, their contacts are opened and closed depending upon the angular rotation of the switching cams 234, 244.

The various contacts of the switch devices 230, 240 include indication contacts and shunt contacts. For the second preferred embodiment, there are six contacts mounted to a shaft 232, 242 for each switch device 230, 240 in which there are four indication contacts and two shunt contacts. By default, the indication contacts are normally closed and the shunt contacts are normally open. The indication contacts remain closed when the point detector bar 20 moves from 0 to 3/16 of an inch. If the point detector bar 20 moves more than 3/16 of an inch, the indication contacts will begin to open so that, just short of ¼ of an inch, all four indication contacts will be open. For the first preferred embodiment, the fourth indication contact is the last one to open and has a light emitting diode ("LED") for adjustment of the point detection and indication apparatus 200. The total range of motion for the switch devices 230, 240 is about 90 degrees. As described above, the unique design of the switch arms 210, 220 provides for such wide range of rotation.

The phases of actuation for the switch devices 230, 240 are as follows:

TABLE 1

| Phase of Actuation | | |
|---|---|---|
| PHASES | RANGE OF MOTION | EVENT |
| 1 | 0° to 8° | First four contacts remain closed whereas last two contacts remain open. |
| 2 | 8° to 14° | First three contacts open, fourth contact remains closed and the last two contacts remain open. |
| 3 | 14° to 16° | First three contacts remain open, fourth contact remains closed and last two contacts close. |
| 4 | 17° | First three contacts remain open, fourth contact opens and last two contacts remain closed. |
| 5 | 17° to 90° | Same as Phase 4. Also, allow for over travel for the switch mechanism. |

A circuit diagram of a main circuit 250 of the second preferred embodiment is shown in FIG. 9. A motor amplifier 252 is the central processor for the main circuit 250. In particular, the motor amplifier 252 controls a 2.5 hp 250 rpm brushless DC motor 254, right and left motor limit switches 256, 258 for turning off the motor at the end of a stroke, and a manual switch 260 to operate the switch machine without switch call information, and a hand throw switch 262 and a hand crank switch 264 to disable the motor 254 if switch contacts (described below) are open. The motor amplifier 252 is also connected to a current select 266 that limits the line current for the switch machine to 17 amps or 20 amps, a speed select 268 to configure the switch machine for 3, 8 or 15 second operation, a 12 volt control 270 and power connection 272 for control and power of the switch machine. Diagnostic outputs 274 are provided for future switch machine diagnostic modules.

The main circuit 250 also includes a latch out switch circuit that includes a latch out switch 278, a set of switch contacts in the Left Point Detector Switch (PDL) 280 and a set of switch contacts in the Right Point Detector Switch (PDR) 282. The three switches are connected in parallel. The motor 254 will be allowed to run if any contacts are closed, but the motor will be disabled if all contacts are open. The proper operation of the main circuit 250 is represented by the following table:

TABLE 2

| Latch Out Swith Circuit | | | |
|---|---|---|---|
| | PDR Indication Contacts PDR LO Contacts | PDL Indication Contacts PDL LO contacts | Latch Out |
| Points are left. | Open | Closed | Open |
| Mid-stroke | Open | Open | Closed |
| Points are right. | Open | Open | Open |

For example, if the switch machine is thrown to the left and there is a ⅜ inch obstruction, the mechanical latchout is actuated and the left point detector switch contacts and the left point detector indication contacts are opened. The latchout and right point detector switches are already open as shown in the above table. Thus, the motor 254 is disabled and the latchout means is reset by adjusting the mechanical latchout trigger inside the switch machine.

As stated above, each switch device of the second preferred embodiment, namely left point detector rotary cam switch 280 and right point detector rotary cam switch 282, include four indication contacts and two shunt contacts. When the switch machine is in correspondence, at least two indication contacts in each switch device will be closed and, thus, indicate that it is safe to pass a train over the switch points. There are two shunting contacts in each switch device that close if the switch machine is in mid-stroke or has a ¼ inch or greater obstruction. The shunting contacts short the relays in the control bungalow of a train yard that indicate safe train passage. If the relays are shorted, it is impossible to clear the signal to allow the train to pass.

In addition, one of the indicator contacts of each switch device is an adjusting contact that turns on or off an LED indicator. The contact operates similar to the other indicator contacts in that the LED is one if the switch machine is in correspondence. However, this adjusting contact is always the last to open. As the rotary cam switches rotate from the indication position to the shunting position, the two indication contacts open first and are followed by the closing of the two shunting contacts. The adjusting contact is always the last to open and, thus, maintenance personnel may use the LED to adjust the switch machine. If the LED is off, the indication contacts are definitively open and the indication contacts are definitively closed.

The invention having been thus described with particular reference to the first preferred forms thereof, it will be obvious that various changes and modifications may be made therein without departing from the spirit and scope of the invention as defined in the appended claims.

Wherefore, we claim:

1. A point detection and indication apparatus for an electric motor driven switch machine, comprising:

a point detector bar having an outer surface;

a point detector cam located on said outer surface;

a pair of cam followers, each of said cam followers having a first end which is contiguous to said outer surface, and a second end;

said second end is positioned at a first position when said first end is positioned adjacent said point detector cam, and said second end is positioned at a second position when said first end is not positioned contiguous to said point detector cam; and a link arm, directly linking said second ends of said pair of cam followers, having tension means;

said tension means being operable for retracting a length of said link arm when at least one of said second ends shifts from said second position to said first position and for extending the length of said link arm when at least one of said second ends shifts from said first position to said second position.

2. The point detection and indication apparatus of claim 1, further comprising means for indicating a problem condition when both of said second ends are positioned at said second positions, wherein said indicating means is connected to said cam followers and determines positions of said second ends.

3. The point detection and indication apparatus of claim 1, further comprising:

a pair of point detector switches for indicating a problem condition when both of said point detector switches are switched to a particular indicating position; and a pair of switch arms, each of said switch arms attached to said cam followers and adjacent to said point detector switches, for switching each of said pair of point detector switches to said indicating positions when said second ends are positioned at said second positions.

4. The point detection and indication apparatus of claim 1, further comprising:

a pair of latch retainers positioned on said link arm, each latch retainer having a retainer body and a retainer ring attached at one end of said retainer body; and a pair of latch bars positioned about said link arm between said latch retainers, each of said latch bars having a contact end;

wherein each of said latch bars has a first latch position such that said contact end does not contact said retainer ring nor said retainer body, a second latch position such that said contact end contacts said retainer ring but does not contact said retainer body, and a third latch position such that said contact end contacts both said retainer ring and said retainer body.

5. The point detection and indication apparatus of claim 4, further comprising:

a latch opener cam having an unlock position and a lock position, wherein said latch opener cam is positioned between said latch bars and positions said latch bars at said first latch positions when said latch opener cam is at said unlock position, and said latch opener cam is not positioned between said latch bars and permits said latch bars to move out of said first latch positions when said latch opener cam is at said lock position; and each of said latch bars having a non-contact end opposite said contact end;

a tension spring attached to said non-contact ends of said latch bars for causing said non-contact ends to draw towards each other and said latch bars to move out of said first latch positions.

6. The point detection and indication apparatus of claim 1, wherein:

one of said latch bars is positioned at said second latch position when one of said second ends of said cam followers is positioned at said first position and said latch opener is at said lock position; and both of said latch bars are positioned at said third latch position when both of said second ends of said cam followers are positioned at said second position and said latch opener is at said lock position.

7. The point detection and indication apparatus of claim 6, further comprising a latch out indicator in contact with said cam followers for indicating a problem condition when both of said latch bars are at said third latch positions.

8. The point detection and indication apparatus of claim 1, further comprising:

a lock bar, positioned below said cam followers, having a slot; and each of said cam followers having a correspondence pin extending down into said slot;

wherein said second end of at least one of said cam followers is positioned at said second position when at least one of said correspondence pins is not positioned within said slot.

9. A point detection and indication apparatus for an electric motor driven switch machine having an activation means, comprising:

a point detector bar having an outer surface;

a point detector cam positioned on said outer surface;

a pair of cam followers, each of said cam followers having a first end adjacent to said outer surface and a second end, wherein said second end is positioned at a first position when said first end is positioned adjacent said point detector cam, and said second end is positioned at said second position when said first end is not positioned adjacent to said point detector cam;

a link arm directly linking said second ends of said pair of cam followers;

a pair of latch retainers positioned on said link arm;

a pair of latch bars positioned about said link arm between said latch retainers, each of said latch bars having a contact end;

each of said latch bars having a first latch position such that said contact end does not contact said latch retainer, and a second latch position such that said contact end contacts said latch retainer;

a latch opener cam having an unlock position for positioning said latch opener cam between said latch bars and said latch bars at said first latch positions, and a lock position for positioning said latch opener cam to one side of said latch bars and said latch bars at said second latch positions; and a latch out switch, responsive to the activation means of the switch machine, for terminating the operation of the switch machine when said latch opener cam is at said lock position and both of said cam followers are at said second position.

10. The point detection and indication apparatus of claim 9, further comprising:

a pair of point detector switches for indicating a problem condition when both of said point detector switches are switched to a particular indicating position; and a pair of switch arms, each of said switch arms attached to said cam followers and adjacent to said point detector switches, for switching each of said pair of point detector switches to said indicating positions when said second ends are positioned at said second positions.

11. A point detection and indication apparatus for an electric motor driven switch machine, comprising:

a point detector bar having cam means;

a pair of follower means, each having a roller end which is contiguous to said point detector bar and a non-roller end;

switch means controlled by said pair of follower means; and means for latching out said switch means responsive to the position of said rollers to said cam means, including means for holding said non-roller ends at a predetermined distance away from each other, wherein said holding means comprises an arm that directly links said non-roller ends to each other.

12. The point detection and indication apparatus of claim 11, wherein said arm has tension means for adjusting the length of said arm.

13. The point detection and indication apparatus of claim 12, wherein said holding means further comprises retainer means located on said arm and latching means, responsive to the position of said rollers to said cam means, for supporting a portion of said retainer means.

14. The point detection and indication apparatus of claim 13, wherein said latch out means further includes latch opener means for adjusting said latching means such that said latching means no longer supports said portion of said retainer means.

15. A point detection and indication apparatus for an electric motor driven switch machine, comprising:

a point detector bar having cam means;

a pair of follower means, each having a roller end which is contiguous to said point detector bar and a non-roller end;

switch means controlled by said pair of follower means;

means for latching out said switch means responsive to the position of said rollers to said cam means, including means for holding said non-roller ends at a predetermined distance away from each other; and a lock bar positioned substantially parallel to, and that correspondingly moves with, said point detector bar, wherein said switch means indicates a problem condition when said lock bar is out of correspondence with said point detector bar.

16. A point detection and indication apparatus for an electric motor driven switch machine, comprising:

a point detector bar having an outer surface and a point detector cam located on said outer surface;

first and second cam followers each having a first follower end that is contiguous to said outer surface and a second follower end, each of said cam followers having a first follower position when said first end portion is positioned adjacent said point detector cam and a second position when said first end portion is not positioned adjacent said point detector cam;

a first switch arm disposed on said first cam follower and a second switch arm disposed on said second cam follower, each of said switch arms having a distal end extending from said second end portion of a respective one of said cam followers; and a switch assembly, having a pair of switching cams for receiving said distal ends of said switch arms, for indicating a problem condition when said contacts are switched within a particular range of indicating positions, wherein each of said distal ends of said switch arms extend beyond a front vertical plane of said switch assembly.

17. The point detection and indication apparatus of claim 16, wherein each of said distal ends of said switch arms extend over a portion of said switch assembly.

18. The point detection and indication apparatus of claim 16, wherein each of said distal ends of said switch arms include a roller for smooth, frictionless contact with a respective one of said switching cams.

19. The point detection and indication apparatus of claim 16, wherein each of said switching cams has an angled surface for receiving a respective one of said distal ends.

20. The point detection and indication apparatus of claim 16, wherein each of said switch arms has a substantially L-shaped form.

21. The point detection and indication apparatus of claim 16, further comprising a link arm, directly linking said second ends of said pair of cam followers.

22. The point detection and indication apparatus of claim 21, wherein said link arm includes a tension means operable for retracting a length of said link arm when at least one of said second ends shifts from said second position to said first position and for extending the length of said link arm when at least one of said second ends shifts from said first position to said second position.

23. A point detection and indication apparatus for an electric motor driven switch machine, comprising:

a point detector bar having an outer surface and a point detector cam located on said outer surface;

first and second cam followers each having a first end that is contiguous to said outer surface and a second end;

a first switch arm disposed on said first cam follower and a second switch arm disposed on said second cam follower, each of said switch arms having a distal end extending from said second end of a respective one of said cam followers; and a switch assembly having a pair of rotatable shafts substantially perpendicular to said distal end of said switch arms and a switching cam disposed at an end of each rotatable shaft, wherein said distal ends of said switch arms are capable of rotating said switching cams and said switch assembly indicates a problem condition when said switching cams are rotated within a particular range of angular rotation.

24. The point detection and indication apparatus of claim 23, wherein each of said distal ends of said switch arm has a first position when said first end portion of said respective cam follower is positioned adjacent said point detector cam, and a second position when said first end portion is not positioned adjacent said point detector cam.

25. The point detection and indication apparatus of claim 23, wherein each of said switching cams has an angled surface for receiving a respective one of said distal ends.

26. The point detection and indication apparatus of claim 23, wherein each of said distal ends includes a roller for smooth, frictionless contact with a respective one of said switching cams.

27. The point detection and indication apparatus of claim 23, wherein said switch assembly includes two switch devices wherein each of said rotatable shafts is positioned at a central vertical portion of each of said switch devices.

28. The point detection and indication apparatus of claim 23, wherein a plurality of contacts are disposed on said rotatable shaft, wherein said contacts open and close depending upon said angular rotation of said switching cams.

29. The point detection and indication apparatus of claim 28, wherein said plurality of contacts includes indication contacts and shunt contacts.

30. The point detection and indication apparatus of claim 29, wherein at least one of said indication contacts is coupled to a light emitting diode for adjustment of said point detection and indication apparatus.

31. The point detection and indication apparatus of claim 29, wherein all of said indication contacts are closed for a first range of movement by said point detector bar, said indication contacts include open contacts and closed contacts for a second range of movement by said point detector bar, and all of said indication contacts are open for a third range of movement by said point detector bar.

32. The point detection and indication apparatus of claim 31, wherein said first range is from about 0 inches to about 3/16 of an inch, said second range is greater than said first range and less than said third range, and said third range is less than ¼ of an inch.

33. The point detection and indication apparatus of claim 23, further comprising a motor for operating the switch machine and a circuit having a latchout switch, a first detector switch and a second detector switch wherein, if said latchout switch is open, said motor is not allowed to run for a non-restorable latchout mode.

34. The point detection and indication apparatus of claim 23, wherein said switching cams have a total range of motion of about 90 degrees.

35. The point detection and indication apparatus of claim 23, further comprising a link arm, directly linking said second ends of said pair of cam followers, wherein said link arm includes a tension means operable for retracting a length of said link arm when at least one of said second ends shifts from said second position to said first position and for extending the length of said link arm when at least one of said second ends shifts from said first position to said second position.

* * * * *